US012337943B2

(12) United States Patent
Kaczmarek

(10) Patent No.: US 12,337,943 B2
(45) Date of Patent: Jun. 24, 2025

(54) RESCUE SLED ASSEMBLY

(71) Applicant: Andre Kaczmarek, Hartford, WI (US)

(72) Inventor: Andre Kaczmarek, Hartford, WI (US)

( * ) Notice: Subject to any disclaimer, the term of this patent is extended or adjusted under 35 U.S.C. 154(b) by 397 days.

(21) Appl. No.: 18/090,880

(22) Filed: Dec. 29, 2022

(65) Prior Publication Data

US 2024/0217632 A1 Jul. 4, 2024

(51) Int. Cl.
*B63C 9/32* (2006.01)
*B63B 45/00* (2006.01)
*B63C 9/00* (2006.01)

(52) U.S. Cl.
CPC ..... *B63C 9/32* (2013.01); *B63C 9/21* (2013.01); *B63C 2009/0023* (2013.01)

(58) Field of Classification Search
CPC .... B63C 9/32; B63C 9/21; B63C 9/20; B63C 2009/0023; B62B 15/00; B62B 15/003; B62B 15/006
See application file for complete search history.

(56) References Cited

U.S. PATENT DOCUMENTS 3,711,879 A * 1/1973 Siefert ..... B63C 9/32 114/43
4,079,953 A * 3/1978 Howarth, Jr. ..... B62B 13/16 280/20
4,968,046 A 11/1990 O'Connell
5,320,567 A 6/1994 Beer
6,379,205 B1 * 4/2002 Wallasch ..... B63C 9/00 440/90
6,641,446 B1 11/2003 Bentley
9,856,001 B2 1/2018 Beer
D845,870 S 4/2019 Beer
10,889,314 B2 1/2021 Kowalski
2004/0217563 A1 * 11/2004 Butts, Jr. ..... B62B 15/00 280/18
2017/0190401 A1 * 7/2017 Beer ..... B63B 1/121

FOREIGN PATENT DOCUMENTS

CA 2101675 9/2000
GB 2374052 A * 10/2002 ..... B63B 7/082

* cited by examiner

*Primary Examiner* — Andrew Polay

(57) ABSTRACT

A rescue sled assembly for use on ice or water includes a pair of floats being buoyant in water and being capable of sliding upon the ice-covered body of water. A frame is coupled to the pair of floats, wherein the frame connects the floats to each other. A plurality of tethers is engaged with the frame and facilitates pulling of the frame and floats in a selected direction and orientation. A plurality of handles is coupled to the frame and provides a grip for a person to grab onto the frame when being pulled out from an opening of an ice-covered body of water. A plurality of light emitters is coupled to the frame and emits light when turned on.

9 Claims, 6 Drawing Sheets

RESCUE SLED ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rescue devices and more particularly pertains to a new rescue device for use when rescuing persons who have fallen through ice on a body of water.

(2) Description of Related Art Including Information Disclosed Under 37 CFR 1.97 and 1.98

The prior art relates to rescue devices and includes a variety of rescue devices comprising a sled being usable on ice or water. Known prior art does not include a rescue device comprising a sled and having lights, handles, and tethers facilitating rescuing a person who has fallen through an opening in an ice-covered body of water.

BRIEF SUMMARY OF THE INVENTION

An embodiment of the disclosure meets the needs presented above by generally comprising a pair of floats being buoyant in water and being capable of sliding upon the ice-covered body of water. A frame is coupled to the floats, wherein the frame connects the floats to each other. A plurality of tethers is engaged with the frame to facilitate pulling of the frame and floats in a selected direction and orientation. A plurality of handles is coupled to the frame and provides a grip for a person to grab onto the frame when being pulled out from an opening of an ice-covered body of water. A plurality of light emitters is coupled to the frame and emits light when turned on. A switch is coupled to the frame and is electrically coupled to the light emitters, wherein the switch is actuated to power the light emitters on or off. A power source is electrically coupled to the plurality of light emitters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
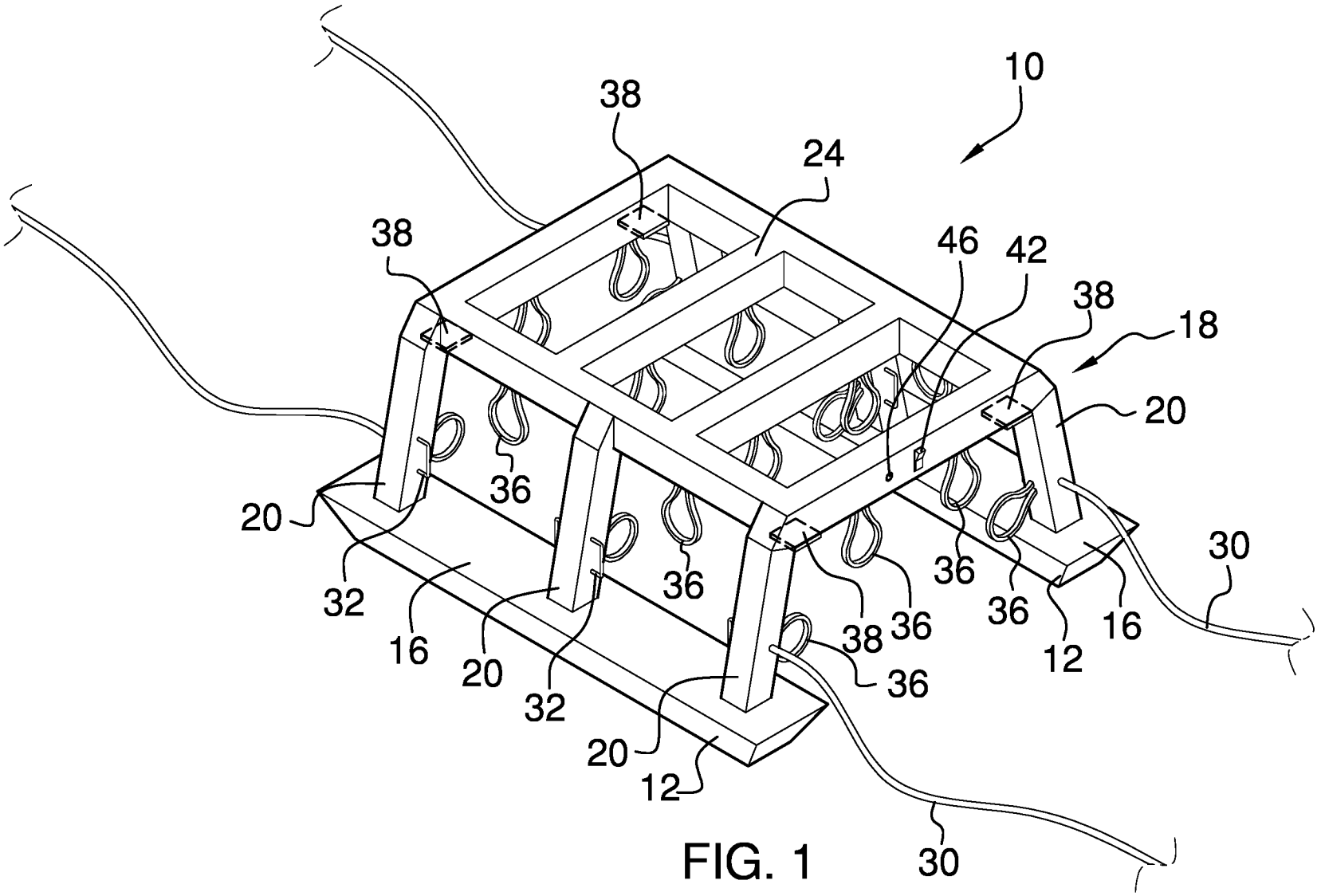
FIG. 1 is a top isometric view of a rescue sled assembly according to an embodiment of the disclosure.
Figure 2:
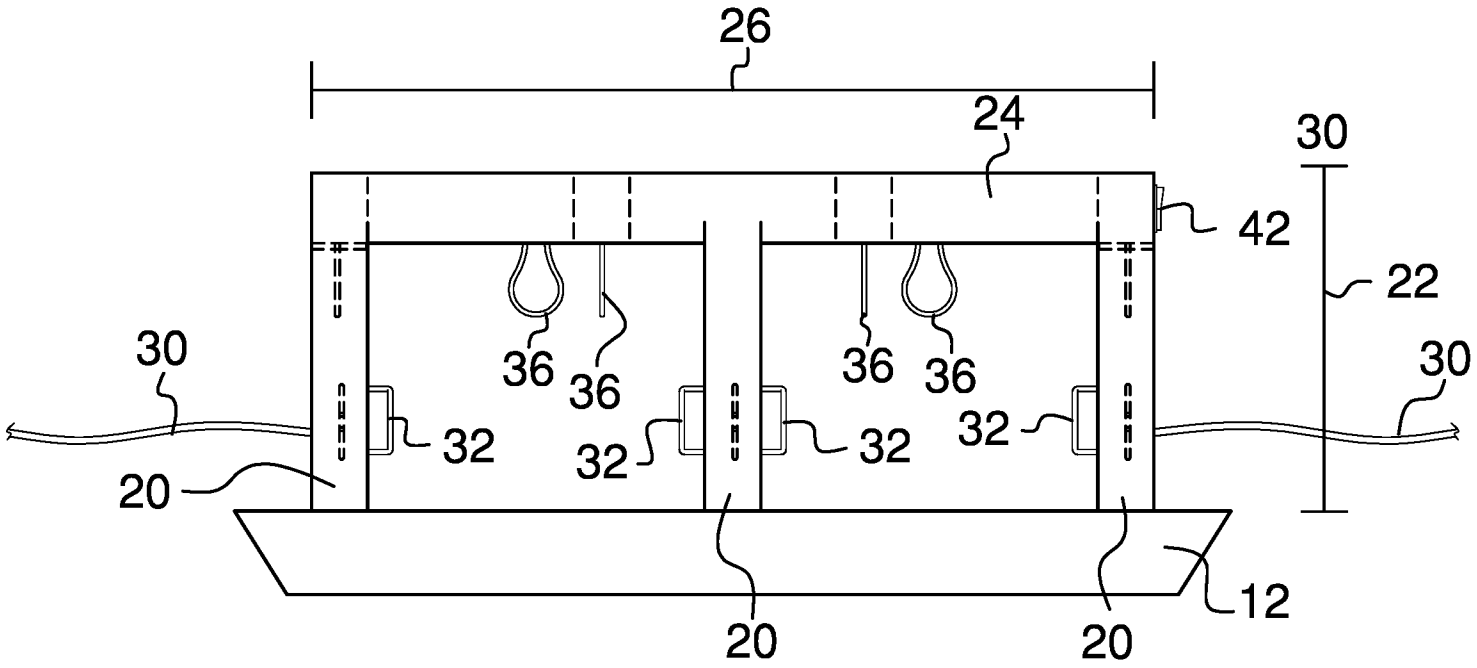
FIG. 2 is a side view of an embodiment of the disclosure.
Figure 3:
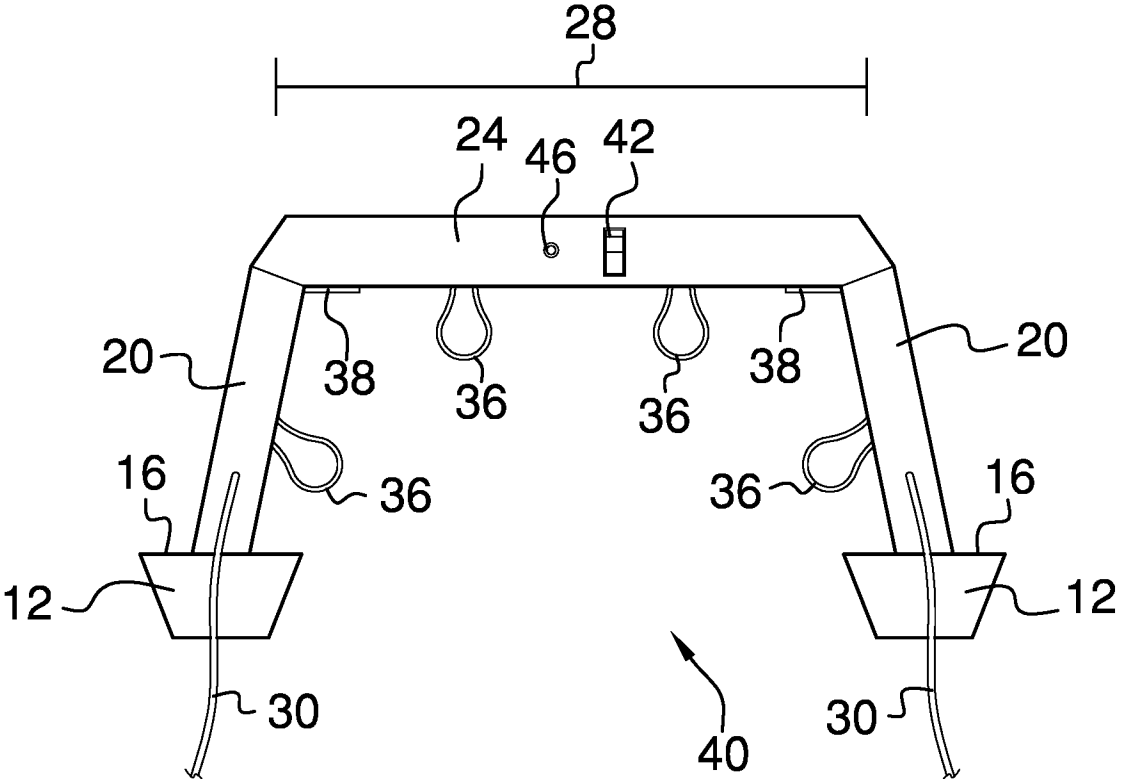
FIG. 3 is a front view of an embodiment of the disclosure.
Figure 4:
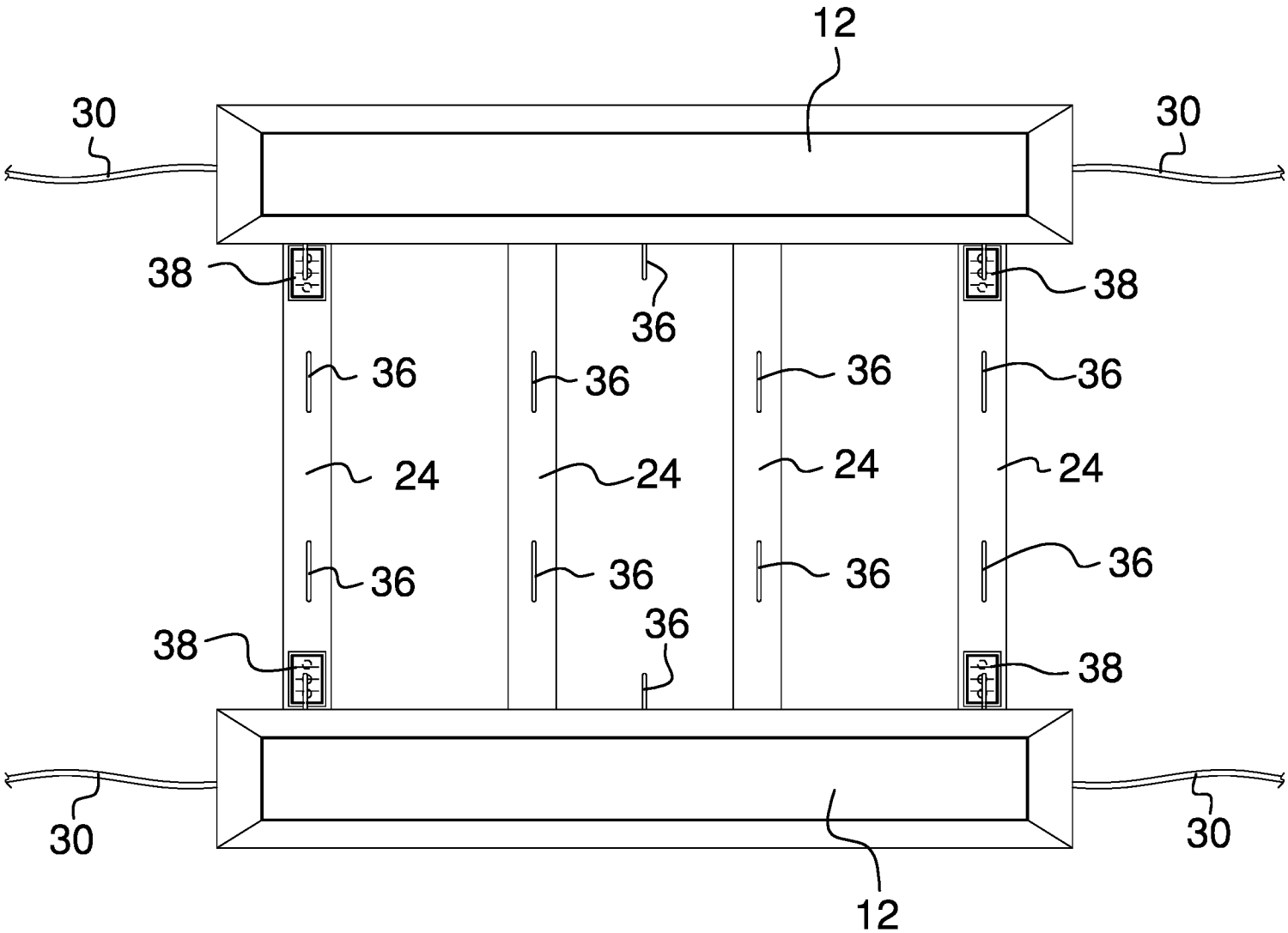
FIG. 4 is a bottom view of an embodiment of the disclosure.
Figure 5:
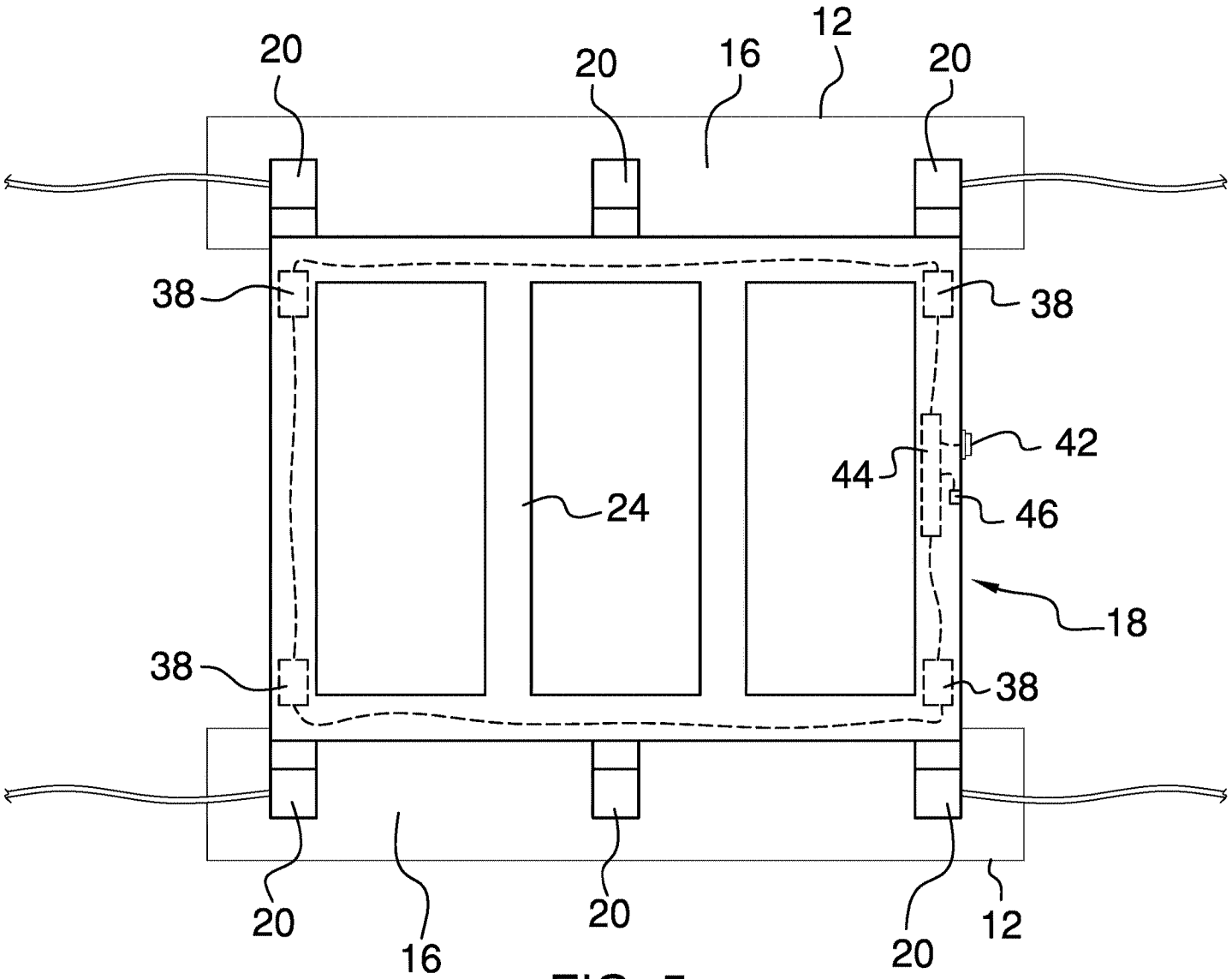
FIG. 5 is a top view of an embodiment of the disclosure.
Figure 6:
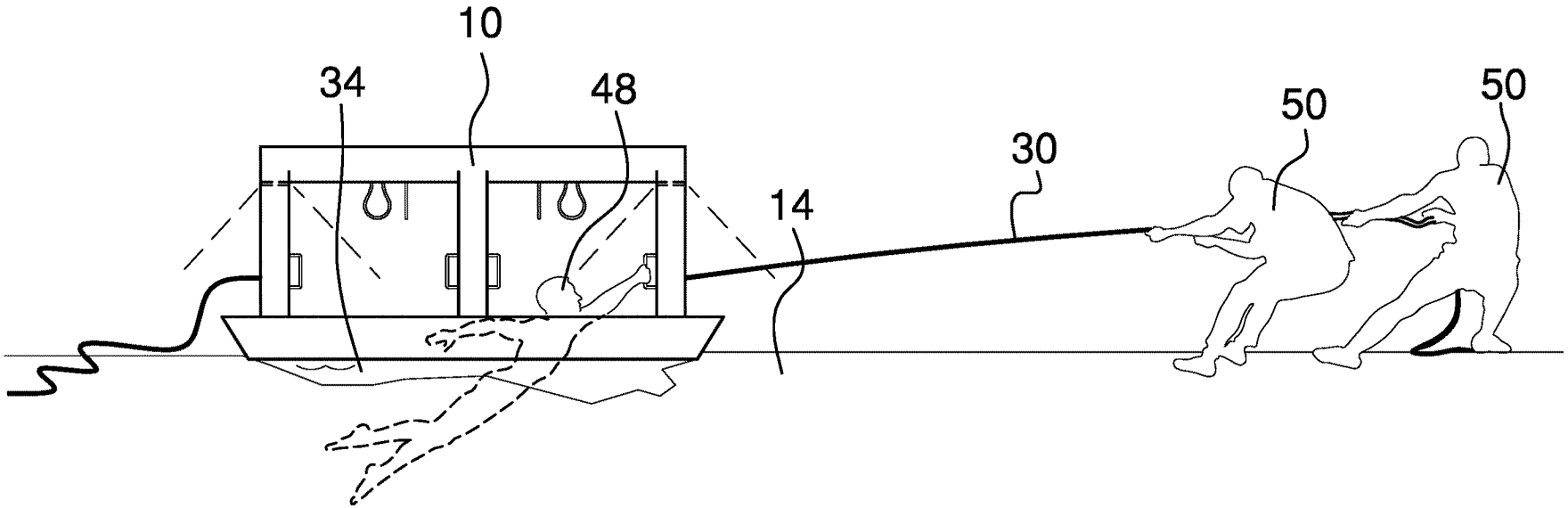
FIG. 6 is an in-use view of an embodiment of the disclosure.

With reference now to the drawings, and in particular to FIGS. 1 through 6 thereof, a new rescue device embodying the principles and concepts of an embodiment of the disclosure and generally designated by the reference numeral 10 will be described.

As best illustrated in FIGS. 1 through 6, the rescue sled assembly 10 generally comprises a pair of floats 12 being buoyant in water and being capable of sliding upon the ice-covered body of water 14. Each float 12 is elongated and has a top wall 16. The floats 12 are spaced from each other and have longitudinal axes orientated parallel to each other. A frame 18 is coupled to the pair of floats 12, wherein the frame 18 connects the floats 12 to each other. The frame 18 includes a plurality of vertical supports 20. Each vertical support 20 has a height 22 from 2.50 feet to 3.50 feet, wherein the height 22 is typically 3.00 feet. Each of the top walls 16 of each of the floats 12 has at least one of the vertical supports 20 attached thereto and extends upwardly therefrom. Each of the top walls 16 will typically have three of the vertical supports 20. A plurality of traversing members 24 is attached to and extends between upper ends of the vertical supports 20 such that the floats 12 are coupled together. The traversing members 24 have a length 26 from 6.00 feet to 8.00 feet and a width 28 from 4.00 feet to 5.00 feet.

A plurality of tethers 30 is engaged with the frame 18 and is configured to facilitate pulling of the frame 18 and floats 12 in a selected direction and orientation. Each tether 30 typically measures from 50.00 feet to 100.00 feet and each tether 30 may be coupled to the vertical supports 20. A plurality of handles 32 is coupled to the frame 18 and provides a grip for a person to grab onto the frame when being pulled out from an opening 34 of the ice-covered body of water 14. The handles 32 may include a plurality of loops 36 coupled to the frame 18. At least some of the loops 36 are positioned on the vertical supports 20 and at least some of the loops 36 are positioned on the traversing members 24. Each of the loops 36 normally comprises a resiliently flexible material.

A plurality of light emitters 38 is coupled to the frame 18 and emits light when turned on. The light emitters 38 are normally positioned to direct emitted light downwardly to a position 40 between the floats 12. A switch 42 is coupled to the frame 18 and is electrically coupled to the light emitters 38, wherein the switch 42 is actuated to power the light emitters 38 on or off. A power source 44 is electrically coupled to the plurality of light emitters 38 and may be positioned within the frame 18. The power source 44 normally comprises a battery and may be rechargeable. A charging port 46 is positioned on the frame 18 and is electrically coupled to the power source 44. The charging port 46 typically receives a port from a charging cord of a power supply.

In use, the rescue sled assembly 10 may be pushed towards the opening 34 to position the rescue sled assembly 10 above or proximate to the opening 34 so that a person 48 who has fallen through the opening 34 is capable to grab onto one of the handles 32 of the rescue sled assembly 10. At least one rescuer 50 may pull on the tethers 30 to pull the rescue sled assembly 10 away from the opening 34 such that the person 48 grabbing onto the handles 32 of the frame 18 will be pulled out from the opening 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sled assembly being configured for pulling a person outwardly through an opening in an ice-covered body of water, said sled assembly comprising:

a pair of floats being buoyant in water and being capable of sliding upon the ice-covered body of water;

a frame being coupled to said pair of floats, wherein said frame connects said floats to each other;

a plurality of tethers being engaged with said frame and being configured to facilitate pulling of the frame and floats in a selected direction and orientation;

a plurality of handles being coupled to said frame and providing a grip for a person to grab onto said frame when being pulled out from the opening;

a plurality of light emitters being coupled to said frame and emitting light when turned on;

a switch being coupled to said frame and being electrically coupled to said light emitters, wherein said switch is actuated to power said light emitters on or off; and a power source being electrically coupled to said plurality of light emitters.

2. The sled assembly of claim 1, wherein each float is elongated, each float having a top wall, said floats being spaced from each other and having longitudinal axes being orientated parallel to each other.

3. The sled assembly of claim 2, wherein said frame includes a plurality of vertical supports, each of said top walls of each of said floats having at least one of said vertical supports attached thereto and extending upwardly therefrom.

4. The sled assembly of claim 3, wherein a plurality of traversing members is attached to and extends between upper ends of said vertical supports such that said floats are coupled together.

5. The sled assembly of claim 3, wherein said tethers are coupled to said vertical supports.

6. The sled assembly of claim 4, wherein said handles includes a plurality of loops being coupled to said frame, at least some of said loops being positioned on said vertical supports and at least some of said loops being positioned on said traversing members, each of said loops comprising a resiliently flexible material.

7. The sled assembly of claim 1, wherein said light emitters are positioned to direct emitted light downwardly to a position between said floats.

8. The sled assembly of claim 1, wherein said power source is positioned within said frame, said power source comprising a battery, said battery being rechargeable, a charging port being positioned on said frame and being electrically coupled to said power source.

9. A sled assembly being configured for pulling a person outwardly through an opening in an ice-covered body of water, said sled assembly comprising:

a pair of floats being buoyant in water and being capable of sliding upon the ice-covered body of water, each float being elongated, each float having a top wall, said floats being spaced from each other and having longitudinal axes being orientated parallel to each other;

a frame being coupled to said pair of floats, wherein said frame connects said floats to each other, said frame including:

a plurality of vertical supports, each of said top walls of each of said floats having at least one of said vertical supports attached thereto and extending upwardly therefrom a plurality of traversing members being attached to and extending between upper ends of said vertical supports such that said floats are coupled together;

a plurality of tethers being engaged with said frame and being configured to facilitate pulling of the frame and floats in a selected direction and orientation, said tethers being coupled to said vertical supports;

a plurality of handles being coupled to said frame and providing a grip for a person to grab onto said frame when being pulled out from the opening, said handles including a plurality of loops being coupled to said frame, at least some of said loops being positioned on said vertical supports and at least some of said loops being positioned on said traversing members, each of said loops comprising a resiliently flexible material;

a plurality of light emitters being coupled to said frame and emitting light when turned on, said light emitters being positioned to direct emitted light downwardly to a position between said floats;

a switch being coupled to said frame and being electrically coupled to said light emitters, wherein said switch is actuated to power said light emitters on or off; and a power source being electrically coupled to said plurality of light emitters, said power source being positioned within said frame, said power source comprising a battery, said battery being rechargeable, a charging port being positioned on said frame and being electrically coupled to said power source.

* * * * *